US005569863A

United States Patent [19]

Lem

[11] Patent Number: 5,569,863

[45] Date of Patent: Oct. 29, 1996

[54] TONE ENHANCER ATTACHMENT FOR STRING-MUSICAL INSTRUMENTS

[76] Inventor: Donald J. Lem, 26 Ridgecrest East, Scarsdale, N.Y. 10583-2012

[21] Appl. No.: 399,237

[22] Filed: Mar. 6, 1995

[51] Int. Cl.[6] ..... G10D 3/14

[52] U.S. Cl. ..... 84/312R; 84/318; 84/453

[58] Field of Search ..... 84/273, 310, 312 R, 84/318, 453

[56] References Cited

U.S. PATENT DOCUMENTS

| | | | |
|---|---|---|---|
| 1,604,657 | 10/1926 | Pederson | 84/310 |
| 1,772,725 | 2/1930 | Lewis | 84/273 |
| 3,971,287 | 3/1976 | Ito | 84/312 R |

*Primary Examiner*—Patrick J. Stanzione

[57] ABSTRACT

An attachment shown in FIG. 1 for string-musical instruments to improve the tone color by tightly clamping a string segment E (91), a string segment A (92), a string segment D (93), and a string segment G (94) between a bridge (60) and a tailpiece (70) with an acoustical material (20) being compressed by a frame (10) and an arm (50). The position, angle of attachment, compression and shape are varied to customize the tone color, without loss of fundamental tone volume. The attachment can be removed by moving a catch and release (40). This returns the instrument to its original state. The tightly clamping of all string segments (91), (92), (93),and (94) together allows common motion of all string segments between bridge (60) and tailpiece (70), but independent vibrations of any one string segment is stopped to higher frequency and is damped by acoustical material (20). The enhanced tone effects increased ease of playing, sonority, dynamic range, and projection.

2 Claims, 3 Drawing Sheets

TONE ENHANCER ATTACHMENT FOR STRING-MUSICAL INSTRUMENTS

BACKGROUND

1. Field of Invention

This invention relates to add-on mechanical attachments to improve the tone color of string-musical instruments.

2. Description of Prior Art

The improvement of the tone produced by string-musical instruments is attempted by altering the placement or physically modifying the various parts of the instrument. This is a very time consuming and expensive, trial and error procedure, that is sometimes irreversible.

Two types of mutes to lower volume of string-musical instruments are related in physical structure. Their application is not to improve the tone, but to damp all tones, U.S. Pat. Nos. 1,772,725 to Lewis(1930) and 3,971,287 to Ito(1976).

OBJECTS AND ADVANTAGES

Tone enchanter attachment objects and advantages are:

(a) to provide an attachment which is easy to apply and remove.

(b) to provide an attachment which when removed restores the original tone.

(c) to provide an attachment which can adjust the enhancement of tone-color without reducing the volume of the desired sounds.

(d) to provide an attractive, artistic attachment that complements the appearance of the musical string-instrument.

(e) to provide an attachment that is inexpensive to manufacture.

(f) to provide an attachment which increases ease of playing, sonority, dynamic range and projection.

Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

| | |
|---|---|
| 10 frame | 20 acoustical material |
| 21 acoustical material E | 22 acoustical material A |
| 23 acoustical material D | 24 acoustical material G |
| 30 hinge | 40 catch and release |
| 50 arm | 60 bridge |
| 70 tailpiece | 80 flexible post |
| 91 string segment E | 92 string segment A |
| 93 string segment D | 94 string segment G |
| 100 clamp | |

DESCRIPTION

Figure 1:
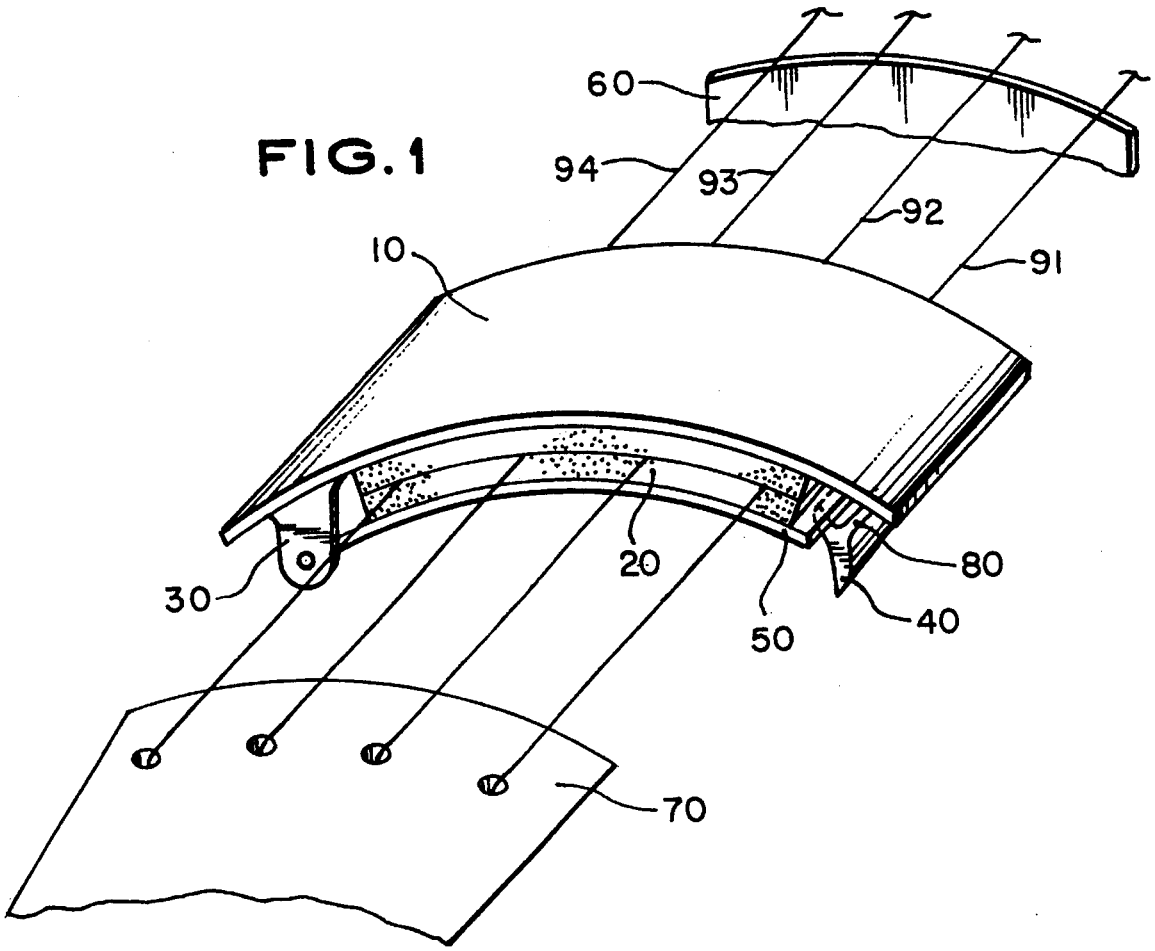
FIG. 1 shows a perspective view of the tone enhancer attachment placed and attached.
Figure 2:
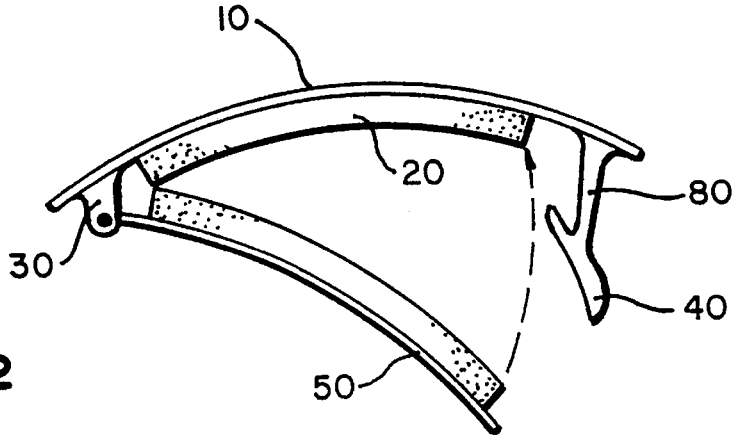
FIG. 2 shows a side view of the tone enhancer attachment ready to be placed and attached.
Figure 3A:
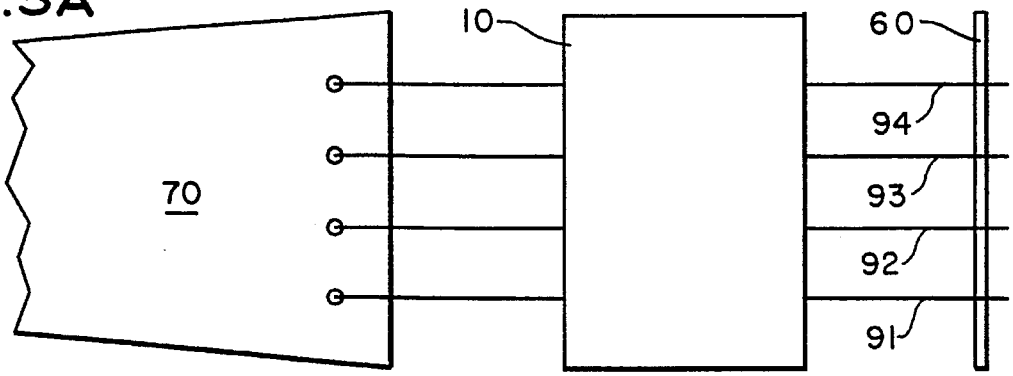
FIGS. 3A to 3C show some tone enhancer attachment size, shape, and placement variations.
Figure 3B:
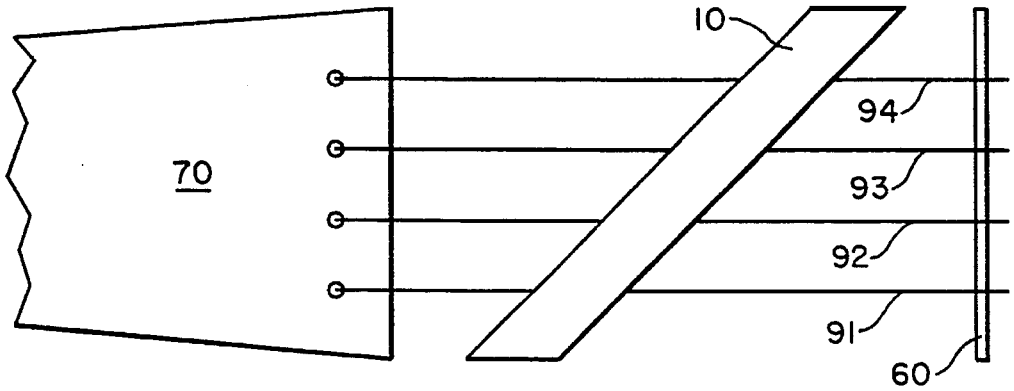
Figure 3C:
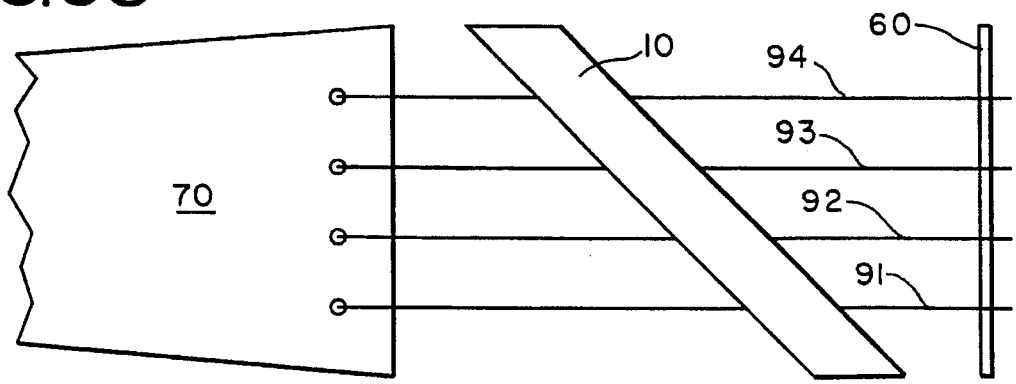

A typical embodiment of a tone enhancer attachment is illustrated in FIG. 1 and 2. A frame 10 (FIG. 1) is shaped to conform to the contour of a string segment E 91, a string segment A 92, a string segment D 93, and a string segment G 94. At one end of frame 10 is attached a hinge 30 (FIG. 1 and 2). Rotating on hinge 30 is an arm 50 (FIG. 1). FIG. 2 shows arm 50 in the open position ready to be placed over string segments 91, 92, 93, and 94 (FIG. 1). FIG. 1 shows arm 50 in the closed and latched position. Lining frame 10 (FIGS. 1 and 2) and arm 50 is an acoustical material 20, Acoustical material 20 is compressed over string segments 91, 92, 93, and 94 (FIG. 1). Attached on the other end of frame 10 (FIGS. 1 and 2) is a flexible post 80 and a catch and release 40. As arm 50 is pressed into catch and release 40, flexible post 80 bends out of the way of arm 50 and catches it. FIG. 1 shows arm 50 after the arm has been caught. In the caught position frame 10 and arm 50 are tightly compressing acoustical material 20 around each of string segments 91, 92, 93, and 94 with a predetermined pressure. To remove tone enhancer attachment from string segments 91, 92, 93, and 94 catch and release 40 is pulled away from the unhinged end of arm 50. The tone color enhancement is altered by changing the position or shape as illustrated in FIGS. 3A to 3C.

Figure 4A:
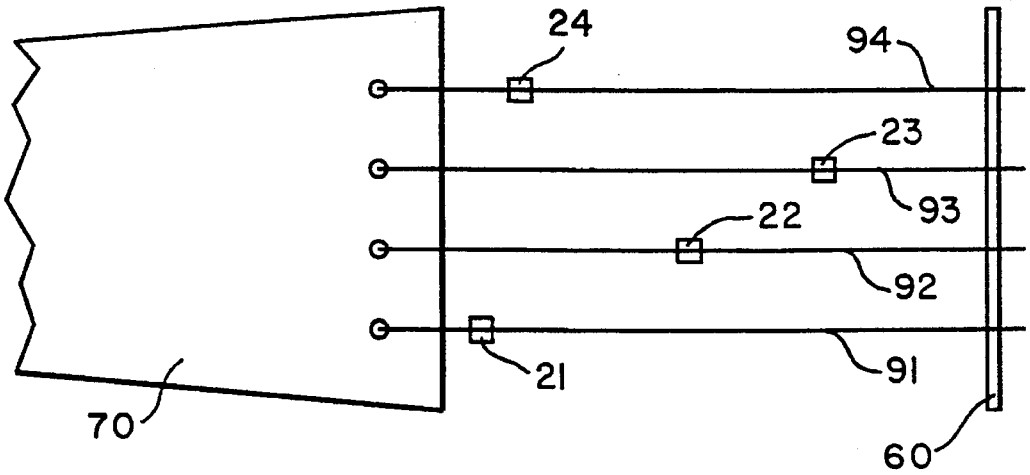
FIGS. 4A and 4B illustrate method of tone enhancement.
Figure 4B:
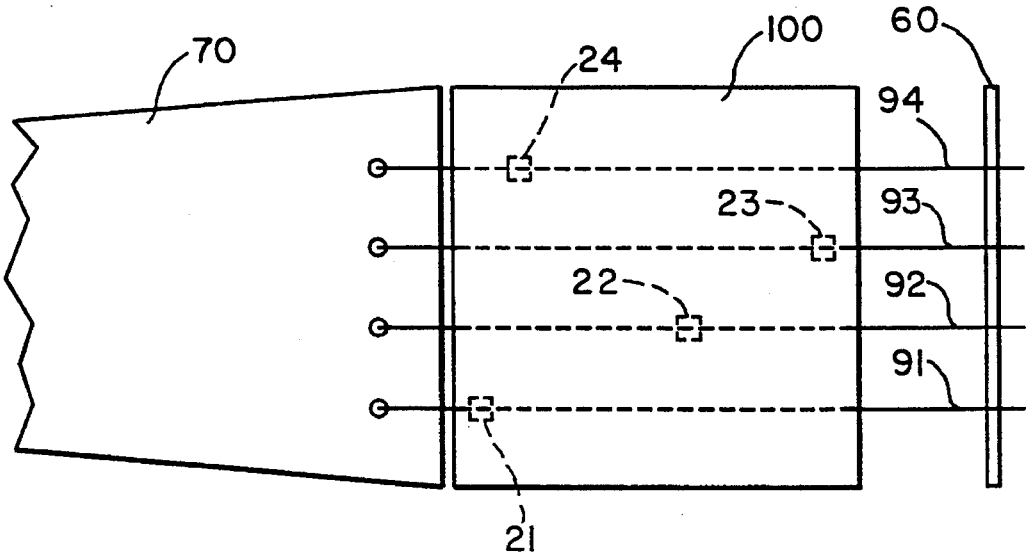

FIGS. 4A and 4B illustrate a method to individually place acoustical material on each string segment to effect tone enhancement. Acoustical material E 21 is placed on string segment E 91 to effect the desired tone enhancement. Acoustical material A 22 is placed on string segment A 92 to effect the desired tone enhancement. Acoustical material D 23 is placed on string segment D 93 to effect the desired tone enhancement. Acoustical material G 24 is placed on string segment G 94 to effect the desired tone enhancement. Then clamp 100 (FIG. 4B) compresses all of the acoustical material together.

OPERATION

Tone enhancer attachment operates on three physical functions to eliminate unwanted sound energy generated between a tailpiece 70 (FIG. 1) and a bridge 60. The independent vibrations of string segment 91, string segment 92, string segment 93, and string segment 94 between tailpiece 70 and bridge 60 are shifted to a higher frequency where the instrument has a much lower resonance, thus lower independent vibration volume. The tight clamping of each string segment 91, 92, 93, and 94 causes the shift of the independent vibrations to a higher frequency by stopping or shortening and dividing each segment into shorter subsegments. Acoustical material 20 virtually damps out the independent vibrations emanating from each of the subsegments. The clamping or coupling together of all string segments 91, 92, 93, and 94 allows the motion of all string segments together not to be suppressed. That is the desired vibration of bridge 60 which makes all string segments move in synchronism is unconstrained, while the independent or non synchronous string segment and subsegment vibrations are damped out.

The placement or position of the clamping or stopping of each string segment 91, 92, 93, and 94 (FIGS. 3A to 3C) changes the frequency shift, which will color the tone of the instrument differently. Some positions producing more pleasant tone than others.

The clamping performs two functions. Placement on individual string segments 91, 92, 93, and 94 divides each segment into two subsegments each with a fundamental frequency higher than the undivided segment. The clamping of all string segments 91, 92, 93, and 94 together enhances vibrations of bridge 60, the desired synchronous vibrations of the string segments.

Acoustical material 20 damps the independent, non synchronous, vibrations of each of the string segments and subsegments between bridge 60 and tailpiece 70. This is the third function. Acoustical material 20 can be substantially hard where all string segments 91, 92, 93, and 94 are clamped together and stopped. Acoustical material 20 can be more pliable on bridge 60 side end tailpiece 70 side of frame 10 with the center of the material being substantially harder. The harder center material stopping each string segment and clamping all string segments together. The softer outer edges of material damping each string subsegment.

This is a tone enhancing method comprised of a group of steps. For the most satisfying tone, the positions of acoustical material 21, 22, 23, and 24 (FIG.4A and 4B), clamped by a clamp 100 (FIG. 4B), is determined in an experimental way, with the ear of the experimenter being the judge. The starting positions of acoustical material can be estimated from a chosen objective. One objective for violins is to have all string subsegments between bridge 60 and acoustical material 21, 22, 23, and 24 with the same fundamental frequency. Another objective for violins is to make all string subsegments between bridge 60 and acoustical material 21, 22, 23, and 24 have a fundamental frequency eight octaves higher then the open string on the other side of bridge 60. For the eight octaves higher objective acoustical material 21, 22, 23, and 24 is placed near bridge 60 at a point one fourth the distance between bridge 60 and tailpiece 70. FIG. 1 illustrates an embodiment resulting from the tone enhancing method with the eight octaves higher objective.

SUMMARY, RAMIFICATIONS, AND SCOPE

Tone enhancer attachment provides an inexpensive way to improve the tone of string-musical instruments which is easy to apply and easy to remove. The removal restores the instrument to its original state. The enhanced tone effects increased ease of playing, sonority, dynamic range, and projection. The enhancement of tone can be tailored by changing such parameters as acoustical material 20 (FIG. 1), frame 10 materials, arm 50 materials, and placement on string segments 91, 92, 93, end 94. The top of frame 10 can be decorated with ebony, boxwood, precious metal, precious jewels, or designs.

Although the description above contains many specificities, these should not be construed as limiting the scope of the invention but as merely providing illustrations of some of the presently preferred embodiments of this invention. For example catch and release 40 (FIG. 1) could be any mechanism used by hair barrettes. Hinge 30 could be any of the hinge methods used by hair barrettes. Shape of frame 10, arm 50, or acoustical material 20 could be very irregular to customize the tone enhancement. The attachment could be integrated and physically connected to tailpiece 70.

Thus the scope of the invention should be determined by the appended claims and their legal equivalents, rather then by the examples given.

I claim:

1. An attachment for musical-string instruments for improving tone color when placed on string segment E, string segment A, string segment D, and string segment G between a bridge and tailpiece of said musical-string instrument and effecting a tight coupling means of all said string segments together to enhance wanted common vibrations of said string segments in synchronism, comprising:

a frame and arm member both comprising first and second ends and shaped to contour said string segments, said frame and arm connected together on said first end by a hinge while releasably connected together on their second ends;

a flexible post that is flexed to release said second end of the arm member from said second end of the frame to allow said arm to swing on said hinge to release said attachment member from said string segments;

and an acoustic material tightly clamped and compressed between the frame and arm member to enhance common vibration between all string segments.

2. The attachment in claim 1 wherein the acoustic material further comprises a pliable first portion and a second portion which is substantially harder, the harder portion stopping each string segment and clamping all string segments together, while the more pliable portion damping each string segment of unwanted independent string vibrations.

* * * * *